US006286216B1

(12) United States Patent
Braun

(10) Patent No.: US 6,286,216 B1
(45) Date of Patent: Sep. 11, 2001

(54) TOOL FOR MAKING CIRCULAR CUTS

(76) Inventor: Elaine A. Braun, P.O. Box 211145, Auke Bay, AK (US) 99821

( * ) Notice: Subject to any disclaimer, the term of this patent is extended or adjusted under 35 U.S.C. 154(b) by 0 days.

(21) Appl. No.: 09/492,524

(22) Filed: Jan. 27, 2000

(51) Int. Cl.[7] ..... B26D 3/00; B43L 9/04

(52) U.S. Cl. ..... 30/310; 30/286; 33/27.031; 33/30.6; 83/879

(58) Field of Search ..... 30/300, 310, 286, 30/293; 83/745, 886, 879; 33/27.031, 27.033, 27.032, 30.6

(56) References Cited

U.S. PATENT DOCUMENTS

| | | | | |
|---|---|---|---|---|
| D. 375,034 | | 10/1996 | Bowser | D8/98 |
| D. 393,196 | | 4/1998 | Klotz | D8/98 |
| D. 409,630 | | 5/1999 | Cornell et al. | D15/127 |
| 1,423,828 | | 7/1922 | Butterfield | 30/307 |
| 2,066,381 | | 1/1937 | Albertson . | |
| 2,230,400 | | 2/1941 | Cadirola . | |
| 3,456,346 | | 7/1969 | Snyder | 30/310 |
| 3,621,574 | | 11/1971 | Yanke et al. . | |
| 3,934,343 | | 1/1976 | Witecki | 30/310 |
| 4,173,913 | | 11/1979 | Nicholson | 30/310 |
| 4,426,781 | | 1/1984 | Kufrin | 30/310 |
| 4,593,467 | | 6/1986 | Safar | 30/310 |
| 4,645,390 | | 2/1987 | Pecha et al. | 30/300 |
| 4,782,730 | | 11/1988 | Picone et al. | 30/300 |
| 4,916,820 | * | 4/1990 | Kozyrski et al. | 83/886 |
| 5,014,436 | | 5/1991 | Kozyrski et al. | 33/27.03 |
| 5,079,843 | | 1/1992 | Shelton et al. | 30/310 |
| 5,233,748 | * | 8/1993 | Logan et al. | 30/310 |
| 5,430,946 | * | 7/1995 | Peters et al. | 30/310 |
| 5,526,573 | * | 6/1996 | Peters et al. | 30/310 |
| 5,860,217 | | 1/1999 | Braun | 30/300 |
| 5,895,183 | | 4/1999 | McDaniel et al. | 30/300 |
| 6,158,133 | * | 12/2000 | Carlson et al. | 30/310 |

FOREIGN PATENT DOCUMENTS

| | | | | |
|---|---|---|---|---|
| 119286 | | 7/1927 | (CH) . | |
| 2910642 | | 9/1980 | (DE) . | |
| 120852 | * | 11/1918 | (GB) | 30/310 |
| 2043519 | | 10/1980 | (GB) . | |

* cited by examiner

*Primary Examiner*—Hwel-Slu Payer
(74) *Attorney, Agent, or Firm*—Richard C. Litman

(57) ABSTRACT

A hand tool for forming circular cutouts of sheet material secures the material so that no generally central penetration in the form of a pilot hole or the like, is required. The resulting cutout is useful in the construction of an article assembled from a series of such blanks or cutouts, such as a quilt assembled from a large number of blanks with the blanks being sewn together at points of mutual contact about their circumferences. The tool comprises a relatively stationary base hub with a shaft extending upwardly therefrom, and a hand pressure knob mounted on the shaft opposite the base hub. A rotary disc with a radial channel having a cutting arm and rotary cutting blade therein, is sandwiched between the base hub and pressure knob. The tool is placed upon the sheet material and pressure is applied to the pressure knob, with the cutting arm and rotary disc being rotated about the hub and knob to drive the cutting blade in a circular path about the hub. The uniform pressure of the rotary disc upon the sheet material being cut ensures that the material cannot gather or deform due to pressure from the cutting disc, thereby providing an accurate circular cutout of material. The cutting disc is adjustable along the cutting arm to provide a wide variety of cutting diameters as desired. The tool is particularly well adapted for cutting fabric materials, but may be used to cut a wide variety of other sheet materials as well.

20 Claims, 4 Drawing Sheets

TOOL FOR MAKING CIRCULAR CUTS

BACKGROUND OF THE INVENTION

1. Field of the Invention

The present invention relates generally to cutting tools, and more specifically to a hand tool for cutting circular blanks of material from a larger sheet. The present tool does not penetrate or damage the center of the blank, and is particularly well suited for cutting patches of material for quilting or other purposes where it is essential that the blank not be damaged in any way.

2. Description of the Related Arts

Certain types of quilting involve the assembly of a series of circular components to form a completed quilt. These circular patches or sections of material are stitched together at adjacent points about their circumferences where they are in contact with one another at final assembly. These circular blanks or components must be cut from a larger sheet of material, in order to supply the required materials for forming such a quilt. While it is possible to cut such blanks by hand using scissors, the work is tedious considering the continuous curved cuts which must be made, and the number of such cuts which are required to provide the large number of circular cutouts necessary for the construction of a quilt.

While devices for making circular cuts have been developed in the past (e. g., fly cutters and the like, etc.), such devices generally form a pilot hole through the material being cut, in order to center the cutter precisely in the material being cut. If the blank is to be discarded, with the purpose of the circular cut being only to provide a circular hole in a sheet of material, then the forming of a pilot hole through the discarded material is of no consequence. However, the forming of a pilot hole through the circular blank is unacceptable in the construction of a quilt, and in various other circular articles which may be needed in other fields as well.

Accordingly, a need will be seen for a hand tool for making circular cuts in fabric and/or other relatively light sheet materials (thin plastic, paper, etc.), without requiring the formation of a pilot hole through the center of the circular blank being cut. The present tool is also adjustable to provide a relatively wide range of diameters for circular blanks being cut therewith, as well as other advantages over earlier tools for making circular cuts. While the present tool is particularly adapted for cutting unbroken circular blanks from fabric material for quilting, it is also readily adaptable for cutting unbroken circular blanks from other materials and for other purposes, as well.

A discussion of the related art of which the present inventor is aware, and its differences and distinctions from the present invention, is provided below.

Essentially, the related art of which the present inventor is aware may be divided into two broad categories, with one category comprising tools and devices which do not penetrate the material being cut, and another category comprising devices which centrally penetrate the material being cut in order to provide a pilot hole for guidance of the tool. Such centrally penetrating tools are relatively far removed from the present circular cutting tool, and are only listed further below with no further discussion of their differences and distinctions from the present invention.

The other category of circular cutting tools includes those tools which do not centrally penetrate the subject material being cut, so that the cut circle of material remains unbroken across its surface and may be used for various purposes (patches, covers, etc.). The tools of this class which are known to the present inventor are described in the following patents and publications:

U.S. Pat. No. 3,621,574 issued on Nov. 23, 1971 to Gerald F. Yanke et al., titled "Photographic Print Circle Cutter," describes a circular cutter in which the disc shaped body of the device has a centrally disposed arm extending therefrom. The arm rotates relative to the body of the device, unlike the present circular cutting tool in which the body and arm both rotate as a unit. In the present tool, the cutting blade mounting bracket is the only component of the arm which is radially adjustable, whereas in the Yanke et al. tool, the arm comprises two relatively telescoping components, with the outer portion being adjustably extendible relative to the pivotally mounted inner portion. Moreover, Yanke et al. utilize an injector type razor blade for their cutting element, rather than a rotary blade as used in the present circular cutting tool.

U.S. Pat. No. 4,426,781 issued on Jan. 24, 1984 to Fred Kufrin, titled "Cutter For Making Paper Discs," describes a device having two concentric discs, with a cutting element adjustably disposed within the inner disc. The outer disc remains stationary during cutting operations to bear against the material being cut, while the inner disc rotates with the cutting element; no separate adjustable radial arm is provided by Kufrin, as provided in the present circular cutting tool. Moreover, Kufrin provides only two blade positions to cut only two different diameters of circles with his cutter, while the present tool provides essentially infinite adjustment between its innermost and outermost limits. Kufrin uses a planar blade as a cutting element, while the present tool utilizes a rotary cutting blade. In addition, the interior of the Kufrin tool is open, while the center of the present tool includes a pad which bears against the material being cut to hold it in place during the cutting operation, while the disc, arm, and cutting blade assembly rotate relative to the central pad and material being held in place by the pad.

U.S. Pat. No. 4,593,467 issued on Jun. 10, 1986 to Tibor Safar, titled "Circular Cutter," describes a machine tool (not a hand tool, as in the present circular cutter) for cutting washers, discs, etc. using a drill press, milling machine, or other suitable power tool to drive the device. The Safar tool essentially comprises a generally enclosed housing with an upper central passage just large enough for passage of a rotary shaft therethrough for rotating the arm with its cutting elements. The bottom of the housing comprises a removably attached disc with a central opening therein for clearing the rotating cutting blades. Safar states that it is preferable to provide a series of different lower discs with different opening diameters, so a disc may be selected which fits closely about the diameter of the cutting circle. This entails removing the disc each time the cutting circle diameter is to be changed, as the cutting arm is internal within the housing, rather than being exposed atop a pressure disc, as in the present cutting tool invention.

U.S. Pat. No. 5,014,436 issued on May 14, 1991 to Vincent T. Kozyrski et al., titled "Circle Cutting System," describes a glass cutter having a stationary center component for bearing against the glass, with a relatively rotary arm extending therefrom. No central rotary disc is provided by Kozyrski et al. for bearing against the material being cut, as provided in the present invention. Moreover, the Kozyrski et al. cutting elements are disposed externally at the end of the rotary arm, whereas the single cutting element of the present invention is internally disposed in the adjustable arm channel of the disc, and concealed beneath the adjustable arm. Thus, the cutting element of the present tool is not exposed and cannot make contact with anything or anyone other than the material disposed therebelow for cutting, unlike the exposed cutting elements of the Kozyrski et al. device.

U.S. Pat. No. 5,860,217 issued on Jan. 19, 1999 to the present inventor, titled "Material Circle Cutter," describes a circular cutter having a plurality of radially disposed rotary cutting blades. In one embodiment, the blades are circumferentially disposed and are not radially adjustable to cut different sizes of circular areas. In another embodiment, the rotary blades are disposed through slots in a base, and may be lifted from the slots for placement in different slots of different diameters in order to provide for the cutting of circular patterns of different diameters. The remainder of the mechanism, including means for lifting the blades from the slots in the base, means for urging the blades downwardly during the cutting operation, and means for adjusting the blades radially for different cutting diameters, rotate relative to the base which remains stationary relative to the material being cut. In contrast, the base of the present cutting tool rotates, along with a radially disposed arm across the base which contains a single radially adjustable rotary cutting disc.

U.S. Pat. No. D-393,196 issued on Apr. 7, 1998 to Sonja Klotz, titled "Radial Cutter," illustrates a design having a single arm apparently supported by a suction cup or the like during use. No central rotary disc is apparent in the Klotz design. Moreover, no radially disposed channel for holding a radially adjustable cutting arm therein is apparent in the Klotz design, which features are a part of the present circular cutting tool invention.

U.S. Pat. No. D-409,630 issued on May 11, 1999 to Robert W. Cornell et al., titled "Circle Cutter," illustrates a device having a relatively thick body portion with the arm containing the cutting element apparently telescoping through the body, rather than being disposed within an open channel above a relatively thin and flat disc, as in the present circular cutter tool. No mechanism is apparent in the Cornell et al. design for adjusting the span of the cutting element, nor for providing for rotation of the cutting arm and other components relative to a fixed central hub portion bearing against the material being cut, which means are a part of the present circular cutting tool invention.

German Patent Publication No. 2,910,642 published on Sep. 18, 1980 to Nippon Tenshashi Co. Ltd. describes (according to the English abstract) a tool having a relatively thick body through which a radially disposed arm passes. The arm has a cutting blade disposed at its distal end. A concentrically disposed holder pad is pressed against the underlying material to hold it in place during cutting operations, with the remainder of the tool being rotated to rotate the arm for cutting a circular patch of material. The body of the device is ribbed, and cannot provide unbroken pressure to essentially the entire area of the material being cut, as provided by the present tool. The central hub which is used to apply pressure to the holder pad is secured by a threaded shaft, as is the radial adjustment for the cutting blade. Such adjustments are tedious and are not required for the routine cutting operations for which the present tool provides.

Finally, British Patent Publication No. 2,043,519 published on Oct. 8, 1980 to Nippon Tenshashi Co., Ltd., titled "A Circle Cutter For Cutting A round Piece From A Sheet Material," describes a device apparently identical to that of the '642 German Patent Publication cited immediately above. The same differences and distinctions between that device and the present invention, are seen to apply here as well.

Tools which penetrate the area of the material being cut are not suitable for providing an undamaged blank of material for use in the manufacture of an article, but rather are directed to making a hole in an article, with the material cut from the hole being discarded. Those penetrating circular cutting tools which damage the material being cut are only listed below, as no further detailed discussion of their differences and distinctions from the present invention is required. These centrally penetrating circular cutting tools comprise:

U.S. Pat. No. 1,423,828 issued on Jul. 25, 1922 to Maurice A. Butterfield, titled "Circle Cutting Tool;"

U.S. Pat. No. 2,066,381 issued on Jan. 5, 1937 to Frans O. Albertson, titled "Disk Tool;"

U.S. Pat. No. 2,230,400 issued on Feb. 4, 1941 to Alessandro Cadirola, titled "Revolving Circular Sheet Cutting Device;"

U.S. Pat. No. 3,456,346 issued on Jul. 22, 1969 to John M. Snyder, titled "Circle Cutter And Protective Cover;"

U.S. Pat. No. 3,934,343 issued on Jan. 27, 1976 to Jacek Witecki, titled "Device For Cutting Circles;"

U.S. Pat. No. 4,173,913 issued on Nov. 13, 1979 to Barrie F. Nicholson, titled "Hole Cutter Having Rotatable Blade Carrier;"

U.S. Pat. No. 4,645,390 issued on Feb. 24, 1987 to Ernst Pecha et al., titled "Cutting Tool For Making Holes;"

U.S. Pat. No. 4,782,730 issued on Nov. 8, 1988 to John Picone et al., titled "Straddling Gasket Cutter;"

U.S. Pat. No. 5,079,843 issued on Jan. 14, 1992 to Joseph A. Shelton et al., titled "Hole Cutter For Ostomy Adhesive Wafers;"

U.S. Pat. No. 5,895,183 issued on Apr. 20, 1999 to Jamie McDaniel et al., titled "Circular Hole Cutter;"

U.S. Pat. No. D-375,034 issued on Oct. 29, 1996 to David G. Bowser, titled "Sandpaper And Fibrous Material Cutter;" and Swiss Patent Publication No. 119,286 published on Jul. 1, 1927 to H. Weibel.

None of the above inventions and patents, taken either singly or in combination, is seen to describe the instant invention as claimed.

SUMMARY OF THE INVENTION

The present invention comprises a hand tool for making circular cutouts from a sheet of material. The present hand tool is particularly valuable in making repetitive circular cutouts of material from a fabric sheet for use in quilting, as the present tool does not penetrate the sheet being cut except at the circumference of the circular patch of material being cut by the tool. The resulting sheet cut by the present tool remains unbroken across its entire span, with no pilot hole or other penetration of the span of material being made by the present tool.

While the present hand tool is particularly useful in making a series of repetitive cuts having the same diameter, it is also easily and quickly adjusted to provide circular cutouts over a wide range of different diameters, as desired. Also, while the present tool is particularly well adapted for use in cutting fabric material for quilting, it is also readily adaptable for use in cutting a wide variety of other thin sheet materials as well, such as plastics, paper, etc.

Accordingly, it is a principal object of the invention to provide an improved hand tool for making circular cutouts of sheet material, which tool provides an unbroken circular cutout devoid of any pilot hole or other penetration or break across its span.

It is another object of the invention to provide an improved circular cutout tool including adjustment means for providing circular cutouts over a wide range of different diameters as desired.

It is a further object of the invention to provide an improved circular cutout tool including a stationary hub which bears against the sheet material being cut, an opposite pressure knob extending therefrom, and a rotary disc, cutting arm, and cutting blade assembly sandwiched between the base hub and the knob.

An additional object of the invention is to provide an improved circular cutout tool which cutting blade comprises a single circular rotary blade disposed beneath the cutting arm and radially adjustable therealong, with guard means also provided.

Still another object of the invention is to provide an improved circular cutout tool the major components of which are easily and economically formed of plastic material, but which may be constructed of other materials as desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
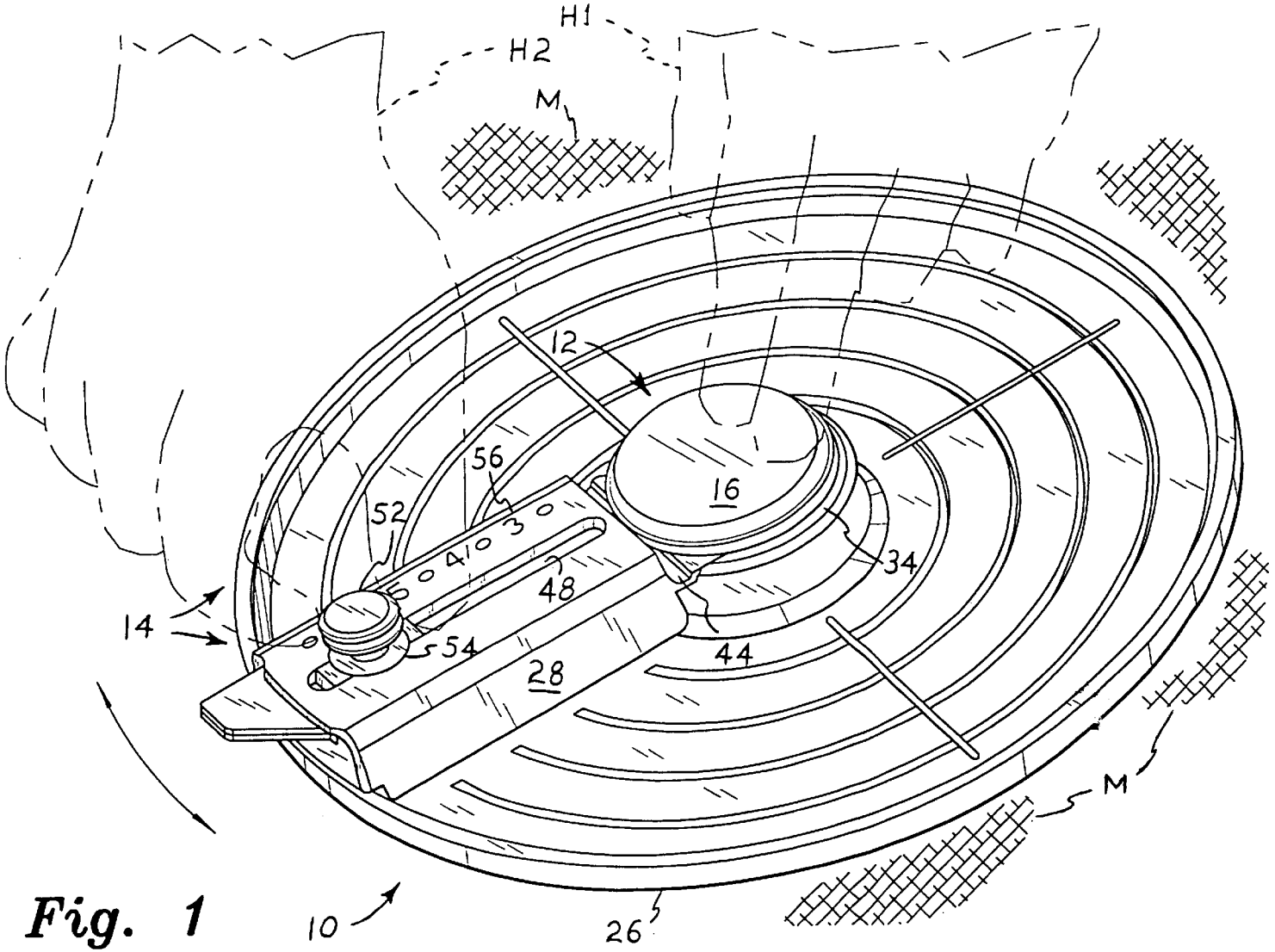
FIG. 1 is an environmental perspective view of the present hand tool in use, showing its operation and basic features.

The present invention comprises a hand tool for forming circular cutouts in sheet material, with the resulting cutouts or blanks being devoid of any penetration or damage to the material across their spans. The present tool 10 is illustrated in operation in FIG. 1 of the drawings, and essentially comprises a stationary central assembly 12 and a moving or rotating outer assembly 14. The stationary central assembly 12 is placed upon the material M from which the circular area is to be cut, with the stationary hand pressure knob 16 being held down by one hand Hl to hold the tool 10 in place. The rotating outer assembly 14 is then rotated about the central assembly 12 by the opposite hand H2, with a cutting blade (shown in FIGS. 2 through 4 of the drawings) penetrating the material M as it rotates about the circumference of a circle defined by the radially adjustable cutting arm 28. As the stationary center assembly 12 does not penetrate the material M, the resulting circular cutout is continuous, and devoid of any pilot holes or other breaks in its continuity.

Figure 2:
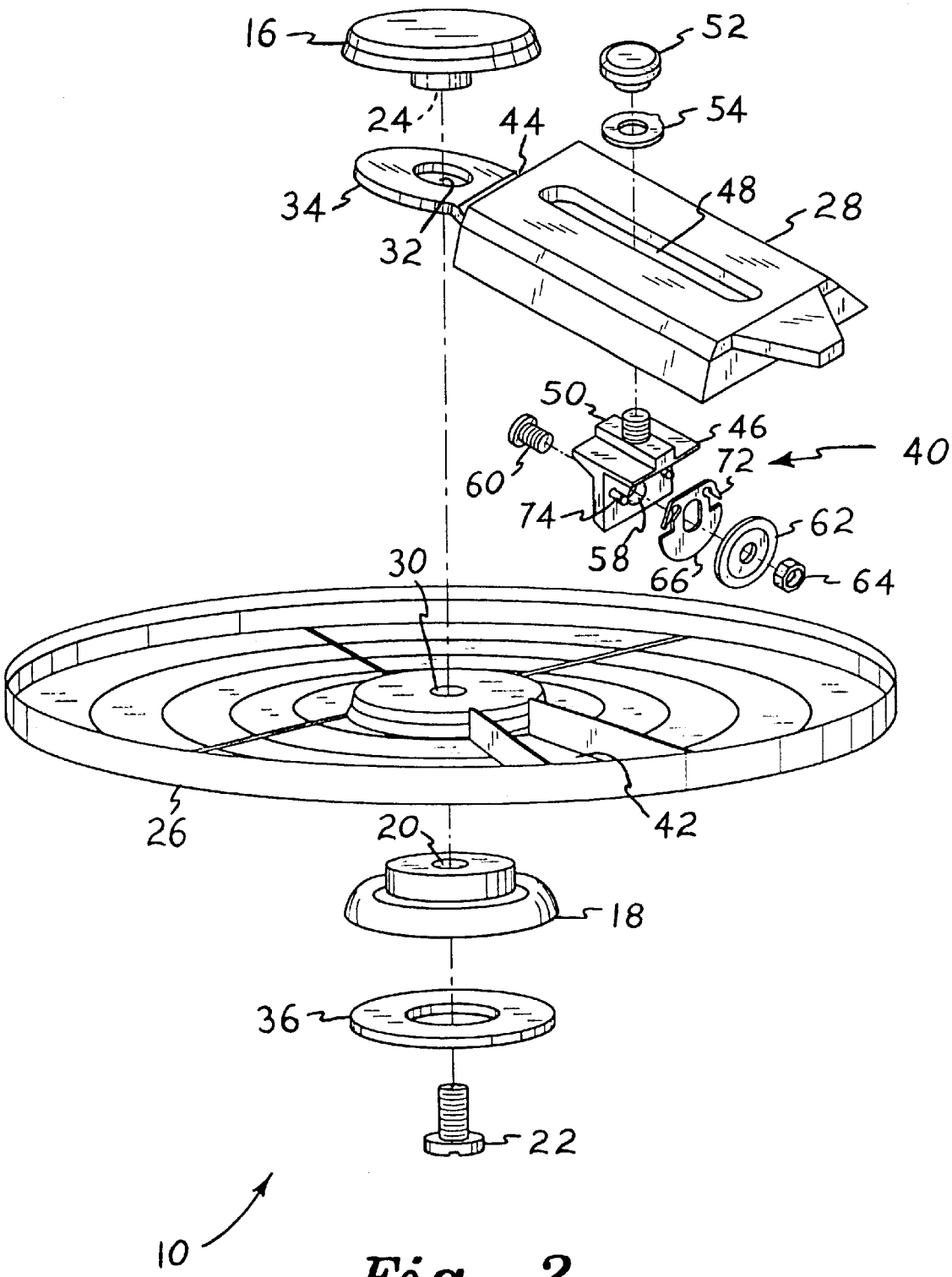
FIG. 2 is an exploded perspective view of the present tool, showing further details of its construction.

FIG. 2 provides an exploded perspective view of the present tool 10, illustrating its various components. The stationary assembly comprises a central base hub 18 having a central passage 20 therethrough, for assembling the present tool 10 by means of a central fastener (e. g., bolt 22). The bolt or fastener 22 passes through the passage 20 of the base hub 18 and into a cooperating threaded blind hole 24 in the upper hand pressure knob 16, to secure the knob 16 and hub 18 immovably together relative to one another. The rotary components, essentially comprising a rotating material pressure disc 26 and cutting arm 28, are captured on the fastener 22 and sandwiched between the upper knob 16 and lower base hub 18 by means of a central passage 30 formed through the rotating pressure disc 26 and a passage 32 formed through an attachment lug 34 of the cutting arm 28.

The base hub 18 preferably includes a soft, resilient pad 36 secured therebeneath. This pad 36 provides a good frictional grip upon the material M being cut, and also compresses when pressure is applied to the upper hand pressure knob 16, allowing the rotary pressure disc 26 to bear lightly against the material being cut to hold it in place during cutting operations. It will be seen that the base hub 18 includes a recess 38 in the base thereof (shown in FIG. 3 of the drawings), allowing the head of the fastener 22 to be raised above the plane of any underlying material. Thus, the present tool 10 is completely devoid of any means of penetrating, cutting, or otherwise damaging the underlying material, except by means of a radially disposed cutting blade, described below.

A cutting blade assembly 40 is adjustably disposed within the cutting arm 28 and a corresponding radially disposed open channel 42 formed in the upper surface of the pressure disc 26. The cutting arm 28 rests over the walls of the channel 42, with the walls of the cutting arm 28 and channel 42 engaging to preclude rotation of the cutting arm 28 relative to the rotary pressure disc 26. Thus, the cutting arm 28 and pressure disc 26 are locked together rotationally, with both rotating together about the relatively stationary center assembly 12. The cutting arm 28 may flex angularly upwardly and downwardly relative to the pressure disc 26 by means of a live hinge, comprising a thinner area or channel 44 formed across the attachment end of the cutting arm 28, between the arm proper and its central attachment ear or lug 34. Thus, as the tool 10 is placed upon the material to be cut, the cutting blade and its guard (discussed further below) are allowed to flex somewhat upwardly to preclude penetration of the material by means of the flexible hinge 44, until pressure is applied to the arm 28 and cutting blade assembly 40 contained therein.

Figure 3:
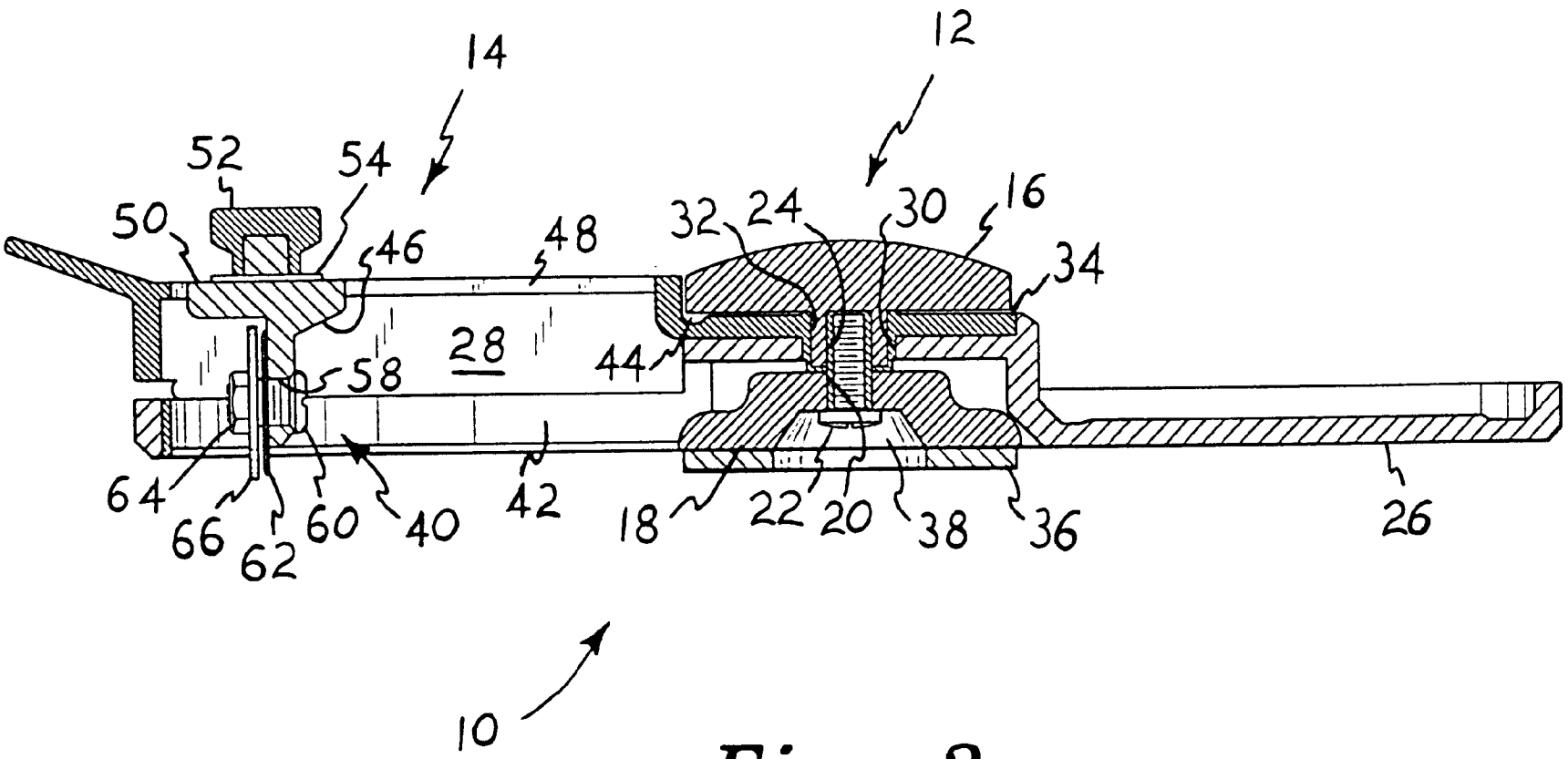
FIG. 3 is a side elevation view in section of the present tool along the cutting arm and channel thereof, showing further details of the tool.

The cutting blade assembly 40 is illustrated in detail in FIGS. 2 and 3 of the drawings. The blade assembly 40 includes a blade mount bracket 46, which is adjustably secured to the cutting arm 28. The cutting arm 28 includes a radially disposed adjustment slot 48 formed therein, with the blade mount bracket 46 having a key 50 formed in the top thereof. The key 50 of the blade mount bracket 46 engages the slot 48 of the cutting arm 28, precluding rotation of the blade mount bracket 46 relative to the arm 28.

The blade mount bracket 46 is captured beneath the cutting art 28 and within the cutting arm channel 42, and is radially adjustable relative to the cutting arm 28, for adjusting thE diameter of the circular area of material to be cut by the present tool 10. The adjustment is selectively fixed by means of a threaded locking knob 52 extending from the key 50; a friction washer 54 may also be provided. When the knob 52 is tightened, the upper portion of the cutting arm 28 is gripped between the bracket 46 and the locking knob 52, thus immovably affixing the blade mount bracket 46 at the desired radial location along the slot 48 of the cutting arm 28 to provide the desired cutting diameter. A scale 56 may be provided along the upper surface of the cutting arm 28 adjacent the adjustment slot 48 if desired, as shown in FIG. 1 of the drawings, to indicate the diameter of a circle cut when the blade mount bracket 46 (and its blade, discussed below) are adjusted to any given radius.

The blade mount bracket 46 has a radially disposed blade attachment bolt passage 58 formed therethrough, i. e., the blade attachment bolt or shaft 60 is oriented with its elongate axis radially disposed relative to the center of the tool 10. A rotary cutting blade 62 is rotatably secured to the blade mount bracket 46 by the bolt 60 and a cooperating nut 64, with its blade aligned to be tangent to the desired circular cutout being made. Other types of blades may be provided if so desired, but the present single rotary blade has been found to work well with the present tool 10.

The cutting blade assembly 40 also includes a blade guard 66, which is affixed adjacent and parallel to the rotary cutting blade 62 by the blade and guard attachment bolt or pin 60 and nut 64. The blade guard 66 normally extends downwardly beyond the lowermost portion of the cutting edge of the blade 62 when no pressure is applied to the lower edge of the guard 66, as shown in FIG. 3 and in greater detail in FIG. 4 of the drawings. However, when downward pressure is applied to the distal end of the cutting arm 28 to force the blade 62 into the material being cut, the blade guard is urged upwardly to expose the cutting edge of the blade 62 and allow the blade to make the desired cut. When downward pressure is relaxed on the arm 28, the guard 66 automatically descends beyond the lower edge of the blade 62 to protect the blade 62 and preclude inadvertent contact therewith.

Figure 4:
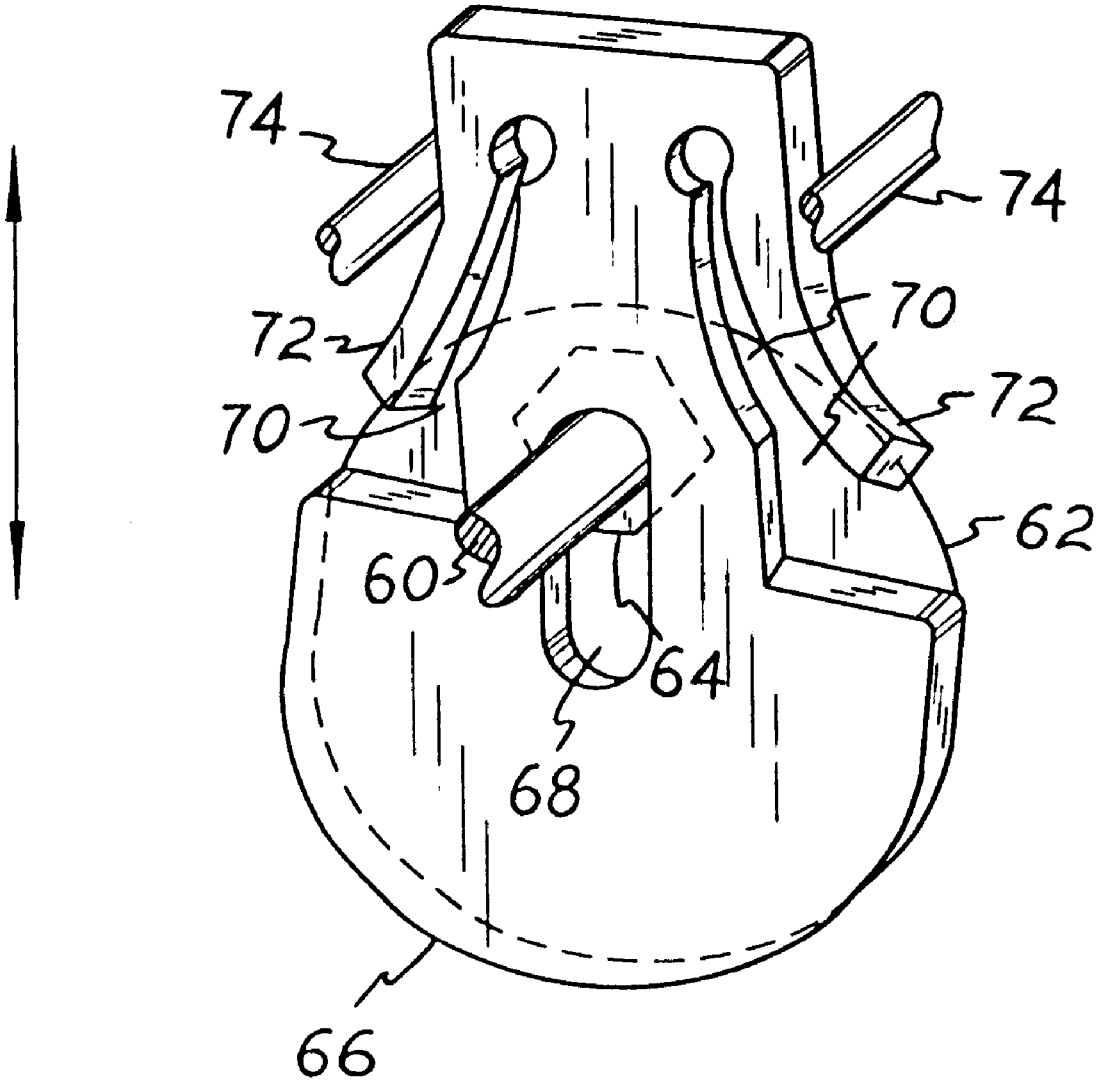
FIG. 4 is a broken away perspective view of the blade guard detail, showing its operation.

FIG. 4 provides a detailed illustration of the structure and operation of the blade guard 66 of the present tool 10. The blade guard 66 includes an elongate vertical slot 68 therethrough, through which the blade and guard mounting bolt or shaft 60 passes. The bolt or pin 60 and cooperating nut 64 do not clamp the blade 62 and guard 66 tightly, but allow the blade 62 to rotate about the bolt or shaft 60 and allow the guard 66 to slide upwardly and downwardly about the bolt or shaft 60 by means of the elongate slot 68 through the guard 66. As noted above, the lower edge of the guard 66 normally extends downwardly beyond the lower edge of the blade 62 when no downward pressure is applied to the arm 28, but retracts automatically to expose the blade when pressure is applied.

The blade guard 66 is laterally symmetrical about the mounting shaft or bolt 60, and includes a recess 70 to each side thereof. An outwardly splayed finger 72 extends from the upper portion of each side of the guard 66, over the corresponding recess 70. These two resilient fingers 72 bear against a corresponding pair of radially disposed pins 74 which extend from the blade mounting bracket 46. As the two fingers 72 are splayed outwardly, they produce a downward urging of the blade guard 66 as they bear against the two pins 74. However, when pressure is applied to the lower edge of the guard 66, as when the tool 10 is placed atop material to be cut and the distal end of the cutting arm 28 is pressed downwardly, as shown in FIG. 1, the blade guard 66 is pushed upwardly about the bolt or shaft 60 against the outward and downward pressure of the fingers 72, thus exposing the lower edge of the cutting blade 62. The fingers 72 are bent resiliently inwardly by their contact with the pins 74 as the guard 66 is pushed upwardly.

When downward pressure on the distal end of the cutting arm 28 is released, the resilience of the splayed fingers 72 urges them outwardly, thereby pushing the guard 66 downwardly as the two fingers 72 spread apart and bear against the pins 74. The rest position of the guard 66, with no weight or force being applied thereto, results in the lower edge of the guard 66 extending downwardly beyond the lower edge of the cutting blade 62 to protect the cutting edge and preclude injury to a person handling the present tool 10, as shown in FIG. 4 of the drawings.

In conclusion, the present cutting tool will thus be seen to provide a significant advance over earlier devices for cutting out circular areas of material. The present tool is economically manufactured, and yet provides quite accurate cutting of circular sections of material for quilting or other purposes as desired. The lack of any material penetrating means in the center of the tool, as is the case in many other tools for forming pilot holes and the like, provides unbroken and undamaged circular cutouts of material by means of the present tool. Yet, the bearing of the relatively stationary center base pad serves to secure the material being cut to preclude wandering or "walking" of the tool during the cutting operation. Moreover, the rotary disc serves to hold the material flat and preclude wrinkles and deformation of the material, resulting in accurate circular cutouts.

Preferably at least the pressure disc, cutting arm, base hub, and pressure knob of the tool are formed of plastic material. Preferably, at least the pressure disc is formed of transparent or at least translucent plastic material, allowing the user of the tool to see through the disc to align the tool accurately over any pattern or markings laid out on the material being cut. While the present tool is adapted particularly well for use in the quilting field, it will be seen that it may be adapted to cut a wide variety of materials, such as light plastics, light and heavy paper, etc., as desired. The versatility, accuracy, ease of use, and economy of the present tool will make it a most desirable accessory for those who have occasion to cut circular sections of material.

It is to be understood that the present invention is not limited to the sole embodiment described above, but encompasses any and all embodiments within the scope of the following claims.

I claim:

1. A hand operated tool for making circular cutouts in a sheet of material, comprising:

a central base hub having a central passage therethrough, and devoid of means for penetrating the sheet of material;

a central hand pressure knob including a central threaded blind hole therein;

a bolt extending through said central passage of said base hub and into said blind hole of said pressure knob, said bolt immovably affixing said base hub and said pressure knob together relative to one another;

a thin material pressure disc rotatably sandwiched between said base hub and said pressure knob;

an open cutting arm channel radially disposed across said pressure disc;

a cutting arm disposed along said cutting arm channel of said pressure disc and rotationally affixed relative thereto;

a blade mount bracket captured within said cutting arm channel of said pressure disc and beneath said cutting arm; and cutting blade means extending from said blade mount bracket and through said cutting arm channel of said pressure disc.

2. The tool according to claim 1, including radial adjustment means for said blade mount bracket for adjusting the diameter of the circular cutouts.

3. The tool according to claim 1, wherein said cutting blade means comprises a single rotary cutting blade.

4. The tool acco rding to claim 1, including guard means for said cutting blade means.

5. The tool according to claim 4, including automatic retraction and extension means for said guard means.

6. The tool according to claim 5, wherein said automatic retraction means comprises:

a blade and blade guard mounting shaft extending generally radially from said blade mount bracket;

said guard means comprising a plate having a lower edge with a generally vertically disposed slot formed through said plate and installed about said blade and blade guard mounting shaft, with said plate riding upwardly about said blade and blade guard mounting shaft by means of said slot when substantial pressure is applied to said lower edge thereof, thereby providing clearance for said cutting blade means;

a pair of spaced apart pins extending generally radially from said blade mount bracket; and a pair of outwardly splayed fingers extending from said guard means, with said pins bearing against said fingers and urging said plate downwardly for extending beyond said cutting blade means when no substantial pressure is applied to said lower edge of said plate.

7. The tool according to claim 1, including a central flange extending from said cutting arm and captured upon said bolt, and a live hinge disposed between said central flange and said cutting arm for moving said cutting blade means into said cutting arm channel of said pressure disc by means of said blade mount bracket.

8. The tool according to claim 1, including a resilient pad disposed beneath said base hub, for compressing against the sheet of material for holding the sheet of material down by means of said pressure disc.

9. The tool according to claim 1, wherein at least said pressure disc, said cutting arm, said base hub, and said pressure knob are formed of plastic.

10. The tool according to claim 1, wherein at least said pressure disc is formed of translucent plastic.

11. A hand operated tool for making circular cutouts in a sheet of material, comprising:

a central base hub having a central passage therethrough, and devoid of means for penetrating the sheet of material;

a central hand pressure knob including a central passage therein;

a shaft extending between said base hub and said pressure knob and connecting said base hub and said pressure knob immovably together relative to one another;

a thin, translucent plastic material pressure disc rotatably sandwiched between said base hub and said pressure knob;

an open cutting arm channel radially disposed across said pressure disc;

a cutting arm disposed along said cutting arm channel of said pressure disc and rotationally affixed relative thereto;

a blade mount bracket captured within said cutting arm channel of said pressure disc and beneath said cutting arm; and cutting blade means extending from said blade mount bracket and through said cutting arm channel of said pressure disc.

12. The tool according to claim 11, including radial adjustment means for said blade mount bracket for adjusting the diameter of the circular cutouts.

13. The tool according to claim 11, wherein said cutting blade means comprises a single rotary cutting blade.

14. The tool according to claim 11, including guard means for said cutting blade means.

15. The tool according to claim 14, including automatic retraction and extension means for said guard means.

16. The tool according to claim 15, wherein said automatic retraction means comprises:

a blade and blade guard mounting shaft extending generally radially from said blade mount bracket;

said guard means comprising a plate having a lower edge with a generally vertically disposed slot formed through said plate and installed about said blade and blade guard mounting shaft, with said plate riding upwardly about said blade and blade guard mounting shaft by means of said slot when substantial pressure is applied to said lower edge thereof, thereby providing clearance for said cutting blade means;

a pair of spaced apart pins extending generally radially from said blade mount bracket;

a pair of outwardly splayed fingers extending from said guard means, with said pins bearing against said fingers and urging said plate downwardly for extending beyond said cutting blade means when no substantial pressure is applied to said lower edge of said plate.

17. The tool according to claim 11, including a central flange extending from said cutting arm and captured upon a bolt, and a live hinge disposed between said central flange and said cutting arm for moving said cutting blade means into said cutting arm channel of said pressure disc by means of said blade mount bracket.

18. The tool according to claim 11, including a resilient pad disposed beneath said base hub, for compressing against the sheet of material for holding the sheet of material down by means of said pressure disc.

19. The tool according to claim 11 wherein said central passage of said hand pressure knob comprises a central threaded blind hole, and said shaft extending between said base hub and said pressure knob comprises a bolt extending through said central passage of said base hub and into said blind hole of said pressure knob.

20. The tool according to claim 11, wherein at least said pressure disc, said cutting arm, said base hub, and said pressure knob are formed of plastic.

* * * * *